US011541432B2

(12) United States Patent
Mitsue

(10) Patent No.: US 11,541,432 B2
(45) Date of Patent: Jan. 3, 2023

(54) CLEANING MACHINE

(71) Applicant: SUGINO MACHINE LIMITED, Uozu (JP)

(72) Inventor: Toyoaki Mitsue, Uozu (JP)

(73) Assignee: SUGINO MACHINE LIMITED, Toyama Prefecture (JP)

( * ) Notice: Subject to any disclaimer, the term of this patent is extended or adjusted under 35 U.S.C. 154(b) by 629 days.

(21) Appl. No.: 16/678,205

(22) Filed: Nov. 8, 2019

(65) Prior Publication Data

US 2020/0246842 A1 Aug. 6, 2020

(30) Foreign Application Priority Data

Feb. 6, 2019 (JP) ..... JP2019-019523
Sep. 2, 2019 (JP) ..... JP2019-159473

(51) Int. Cl.
*B08B 3/04* (2006.01)
*B05B 1/16* (2006.01)
*B05B 7/08* (2006.01)

(52) U.S. Cl.
CPC ..... *B08B 3/04* (2013.01); *B05B 1/1618* (2013.01); *B05B 7/0876* (2013.01)

(58) Field of Classification Search
CPC ..... B05B 7/0876; B05B 1/1618; B08B 3/04
USPC ..... 134/174
See application file for complete search history.

(56) References Cited

U.S. PATENT DOCUMENTS 2,520,397 A * 8/1950 Green ..... B05B 13/0627 239/722
2,862,520 A * 12/1958 Cordova ..... F16K 11/0565 137/636.2
3,913,620 A * 10/1975 Pauliukonis ..... F16K 31/423 251/333
7,300,000 B2 * 11/2007 Kitamura ..... B05B 7/0441 239/263.1

(Continued)

FOREIGN PATENT DOCUMENTS

DE 3124125 A1 1/1983
EP 0058559 A1 8/1982
WO 2016011830 A1 1/2016

OTHER PUBLICATIONS

Extended European Search Report dated Jun. 9, 2020 in an corresponding European patent application No. 19207409.4.

*Primary Examiner* — Chee-Chong Lee
*Assistant Examiner* — Kevin Edward Schwartz
(74) *Attorney, Agent, or Firm* — United IP Counselors, LLC

(57) ABSTRACT

The present invention provides a cleaning machine capable of selecting a spray head independently of a rotational phase of a nozzle.

The cleaning machine includes a slide, a pump, a main valve, a nozzle switching valve, a compressed air source, a swivel joint, a motor, and a nozzle block. The nozzle switching valve has an inflow chamber, a first chamber, a second chamber, a stem, a conical first valve element abuttable against the first valve seat, a conical second valve element abuttable against the second valve seat, a piston, and a spring. The swivel joint has a swivel housing, a swivel shaft, a first nozzle flow path and a second nozzle flow path.

(Continued)

The nozzle block has a first nozzle connected to the first nozzle flow path and a second nozzle connected to the second nozzle flow path.

15 Claims, 7 Drawing Sheets

(56) References Cited

U.S. PATENT DOCUMENTS

| | | | | |
|---|---|---|---|---|
| 8,181,890 | B2 * | 5/2012 | Zilai | B08B 9/0936 134/191 |
| 8,453,678 | B2 * | 6/2013 | Neff | F16K 11/0712 251/360 |
| 10,670,155 | B2 * | 6/2020 | Patterson | F16K 31/122 |
| 10,864,640 | B1 * | 12/2020 | Innes | B08B 9/0933 |
| 11,311,920 | B2 * | 4/2022 | Innes | B05B 3/028 |
| 2004/0089329 | A1 * | 5/2004 | Bijster | B08B 9/0936 134/167 R |
| 2007/0113906 | A1 * | 5/2007 | Sturman | H01F 5/003 137/625.65 |
| 2017/0173617 | A1 | 6/2017 | Zilai et al. | |
| 2022/0003324 | A1 * | 1/2022 | Hosokawa | F16K 41/10 |

* cited by examiner

CLEANING MACHINE

CROSS-REFERENCE TO RELATED APPLICATIONS

This application claims the benefit of priority to Japanese Patent Application No. 2019-019523, filed on Feb. 6, 2019, and Japanese Patent Application No. 2019-159473, filed on Sep. 2, 2019, the entire contents of which are hereby incorporated by reference.

BACKGROUND

1. Technical Field

The present invention relates to a cleaning machine.

2. Description of the Background

There has been proposed a nozzle including a nozzle handle mounted on a rotating shaft, a lifting rod disposed on the nozzle handle, a lifting rod penetrating the left and right valve seats, a bearing follower disposed outside the nozzle handle and configured to push the tip of the lifting rod, a main flow passage disposed on the nozzle handle, a first sub-flow passage, a second sub-flow passage, a first spray head connected to the first sub-flow passage, and a second spray head connected to the second sub-flow passage. The nozzle changes the flow path by rotation (WO2016/011830, hereinafter, Patent Literature 1).

BRIEF SUMMARY

According to the cleaning machine to which the nozzle of Patent Literature 1 is applied, the rotational phase of the nozzle when the second spray head is selected is limited. According to the nozzle of Patent Literature 1, the force by which the bearing follower pushes out the lifting rod is applied to the mounting portion of the nozzle.

It is an object of the present invention to provide a cleaning machine in which the spray head is selected independently from the rotational phase of the nozzle. It is another object of the present invention to provide a cleaning machine in which an unnecessary force is not applied to a nozzle.

One or more aspects of the present invention provides a cleaning machine, including:

a slide having a head portion;

a pump configured to discharge cleaning liquid;

a main valve connected to the pump;

a nozzle switching valve arranged to the head portion, the nozzle switching
valve including,
a valve housing,
an inflow chamber having an inflow port connected to the main valve,
a first chamber having a first nozzle port, a first opening, and a first valve seat arranged around the first opening, the first chamber connected to the inflow chamber via the first opening,
a second chamber having a second nozzle port, a second opening, and a second valve seat arranged around the second opening, the second chamber connected to the inflow chamber via the second opening,
a stem slid ably supported by the valve housing, the stem penetrating the inflow chamber, the first opening, and the second opening, a first valve element having a conical shape, the first valve element arranged on the stem inside the inflow chamber, the first valve element configured to abut against the first valve seat,
a second valve element having a conical shape, the second valve element arranged on the stem inside the inflow chamber, the second valve element configured to abut against the second valve seat,
a cylinder chamber arranged along the stem,
a piston partitioning the cylinder chamber into a first cylinder chamber and a second cylinder chamber, the piston configured to slide inside the cylinder chamber, the piston connected to the stem, and
a spring configured to urge the piston from the first cylinder chamber toward the second cylinder chamber;

a compressed air source connected to the second cylinder chamber;

a swivel joint arranged to the head portion, the swivel joint including,
a swivel housing,
a swivel shaft rotatably supported inside the swivel housing,
a first nozzle flow path connected to the first nozzle port, and
a second nozzle flow path connected to the second nozzle port;

a motor configured to rotate the swivel shaft; and a nozzle block arranged to the swivel shaft, the nozzle block including,
a first nozzle connected to the first nozzle flow path, and
a second nozzle connected to the second nozzle flow path.

The spring urges the stem from the first cylinder chamber toward the second cylinder chamber. The spring may be arranged inside the first cylinder chamber. The spring may also be located at the end of the stem.

For example, the first valve element, the second valve element, the first valve seat, and the second valve seat are made of metal. The first valve element and the second valve element may be made of ceramic. Preferably, the first valve element and the second valve element are harder than the first valve seat and the second valve seat. The first valve element is in direct contact with the first valve seat, and the second valve element is in direct contact with the second valve element.

The cleaning machine of the present invention allows the spray head to be selected independently of the rotational phase of the nozzle. According to the cleaning machine of the present invention, unnecessary force does not act on the nozzle.

DETAILED DESCRIPTION

Figure 1:
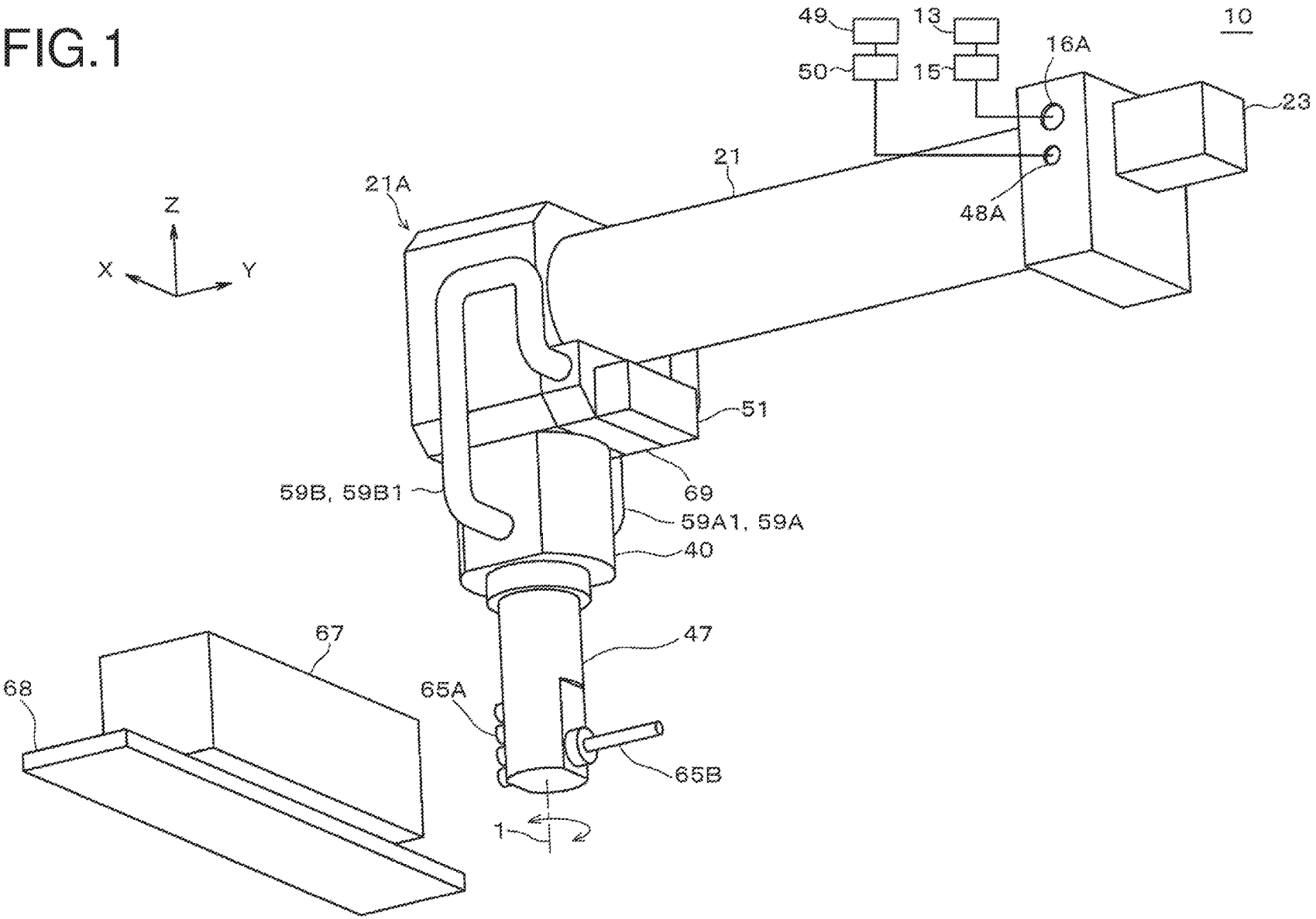
FIG. 1 is a perspective view of a cleaning machine of the embodiment.
Figure 2:
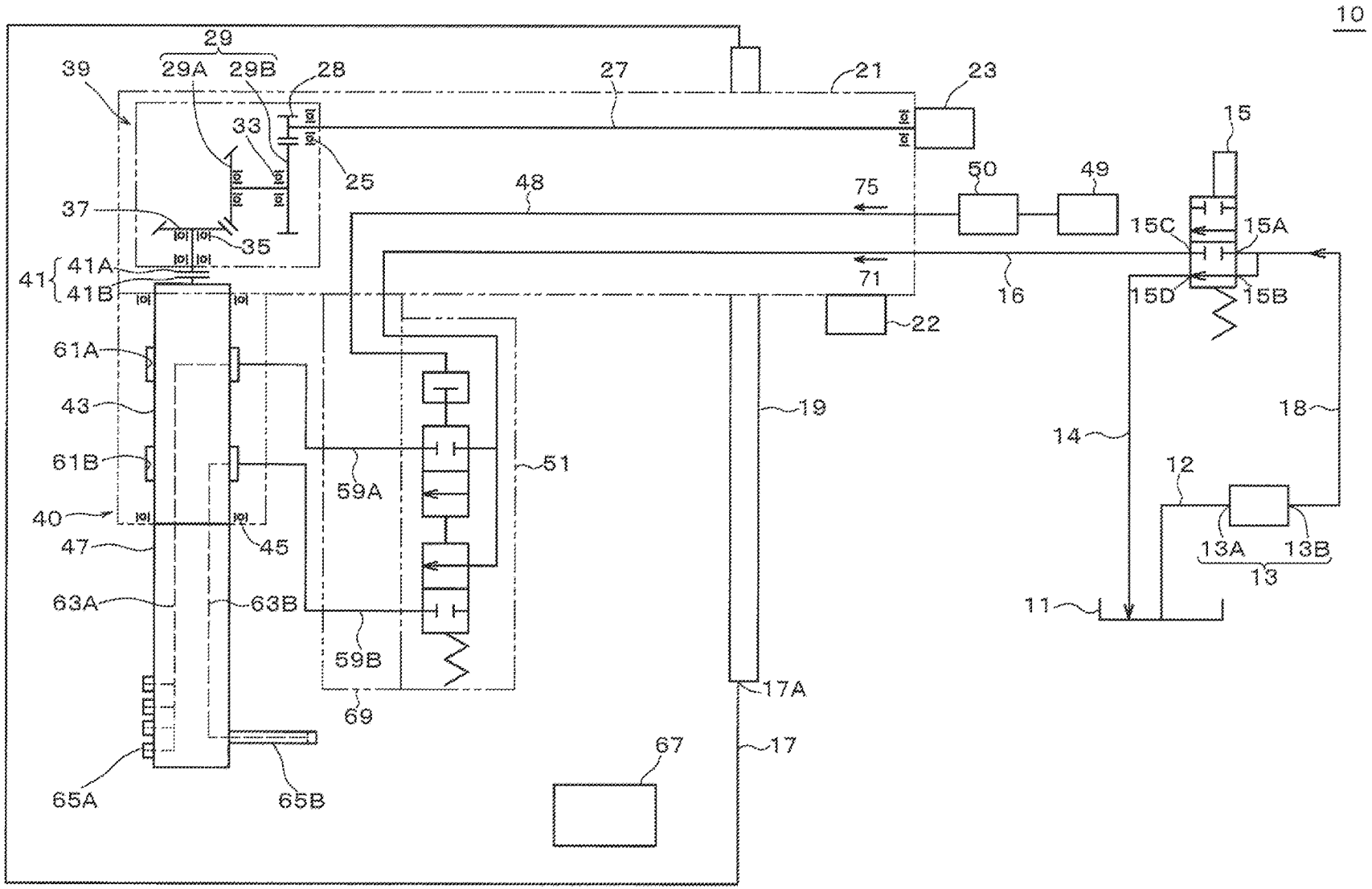
FIG. 2 is a structural view of the cleaning machine of the embodiment.

As shown in FIGS. 1 and 2, the cleaning machine 10 according to the embodiment includes a slide 21, a motor 23, a pump 13, a main valve 15, a compressed air source 49, a nozzle switching valve 51, a swivel joint 40, and a nozzle block 47. The cleaning machine 10 may include a solenoid valve 50, a manifold 69, a first flow path, a second flow path, a first nozzle 65A, a second nozzle 65B, a table 68, a tank 11, a cleaning chamber 17, a telescopic cover 19, a propeller shaft 27, a gear device 39, a coupling 41, and a moving device 22. The first flow path has a first nozzle flow path 63A, a first annular flow path 61A, and a third nozzle flow path 59A. The second flow path has a second nozzle flow path 63B, a second annular flow path 61B, and a fourth nozzle flow path 59B. The table 68 fixes the drying object 67.

The nozzle block 47 rotates about the rotation axis 1. The rotation axis 1 extends in a direction different from the longitudinal direction of the slide 21. For example, the slide 21 extends in the front-rear direction (Y direction) when viewed from the front, and the rotation axis 1 extends in the vertical direction (Z direction). The table 68 and the object 67 may rotate about an axis in the left-right direction (X direction). The moving device 22 is, for example, a traverse column. The slide 21 is disposed on the moving device 22 so as to be movable in the XYZ direction.

The cleaning chamber 17 has an opening 17A. The table 68 and the object 67 are arranged in the cleaning chamber 17. A telescopic cover 19, which is movable in the XZ direction, covers the opening 17A. The slide 21 penetrates the telescopic cover 19. A head portion 21A, the nozzle switching valve 51, the manifold 69, the swivel joint 40, the nozzle block 47, the third nozzle flow path 59A, and the fourth nozzle flow path 59B are disposed inside the cleaning chamber 17. The head portion 21A is a distal end portion of the slide 21. The motor 23, the compressed air source 49, the solenoid valve 50, the tank 11, the pump 13, and the main valve 15 are disposed outside the cleaning chamber 17.

The cleaning machine 10 has a supply flow path 12, a return flow path 14, a discharge flow path 18, and a cleaning flow path 16. The tank 11 stores the cleaning liquid 71.

The pump 13, which is a liquid pump, has a suction port 13A and a discharge port 13B. The pump 13 is, for example, a centrifugal pump, a gear pump, or a piston pump. The flow path 12 connects the tank 11 and the suction port 13A. The pump 13 discharges the cleaning liquid 71.

The main valve 15 is, for example, a four-port two-position valve having two inlets 15A, 15B and two outlets 15C, 15D. The main valve 15 may have two on-off valves, and only one of the valves may be opened.

The flow path 18 connects the discharge port 13B and the two inlets 15A, 15B.

The flow path 14 connects the outlet 15D and the tank 11.

The cleaning flow path 16 connects the outlet 15C and the nozzle switching valve 51. The cleaning flow path 16 extends inside the slide 21 along the slide 21. The cleaning flow path 16 has a connection port (a first inlet) 16A. The connection port 16A is located at the base end of the slide 21 and is disposed outside the cleaning chamber 17.

The compressed air source 49 is, for example, a compressor or a connection port to the compressor. The compressed air source 49 supplies compressed air 75 to the nozzle switching valve 51.

The cleaning machine 10 has an air flow path 48. The air flow path 48 has a connection port (an air inlet) 48A. The connection port 48A is located at the base end of the slide 21 and is disposed outside the cleaning chamber 17. The air flow path 48 extends inside the slide 21 in the longitudinal direction of the slide 21.

Parts of the air flow path 48, the cleaning flow path 16, the third nozzle flow path 59A, and the fourth nozzle flow path 59B may be disposed in the manifold 69. The nozzle switching valve 51 may be disposed in the head portion 21A via the manifold 69. The manifold 69 and the nozzle switching valve 51 of the present embodiment are disposed in the head portion 21A. The manifold 69 and the nozzle switching valve 51 may extend laterally and be disposed below the slide 21.

The third nozzle flow path 59A connects the nozzle switching valve 51 and the swivel joint 40. As shown in FIG. 1, the third nozzle flow path 59A includes a first pipe 59A1. The first pipe 59A1 is disposed outside the head portion 21A. The first pipe 59A1 has a "π" shape in a side view, and is disposed on the side of the head portion 21A. The fourth nozzle flow path 59B includes a second pipe 59B1. The second pipe 59B1 has substantially the same shape as the first pipe 59A1.

The slide 21, which is hollow, has, for example, a circular cross-section or a rectangular cross-section.

The motor 23 is disposed base end of the slide 21. The motor 23 is, for example, a servo motor.

The propeller shaft 27 is disposed inside the slide 21 along the slide 21. Both ends of the propeller shaft 27 are supported by bearings 25. The propeller shaft 27 is connected to the motor 23.

The gear device 39 is disposed in the head portion 21A. The gear device 39 has a pinion 28, a coupling gear 29 and a bevel gear 37. The coupling gear 29 has a large gear 29B and a bevel gear 29A coupled to the large gear 29B. The pinion 28 is fixed to the distal end of the propeller shaft 27. The coupling gear 29 is supported by a bearing 33. The large gear 29B meshes with the pinion 28. The bevel gear 29A meshes with the bevel gear 37.

The coupling 41 has a first coupling 41A and a second coupling 41B. The first coupling 41A is fixed to the bevel gear 37. The bevel gear 37 and the first coupling 41A are supported by the bearing 35. The second coupling 41B is, for example, a key. The first coupling 41A is, for example, a key groove capable of sliding the second coupling 41B. The coupling 41 transmits the rotation of the bevel gear 37 to the nozzle block 47 via the swivel joint 40.

Figure 3:
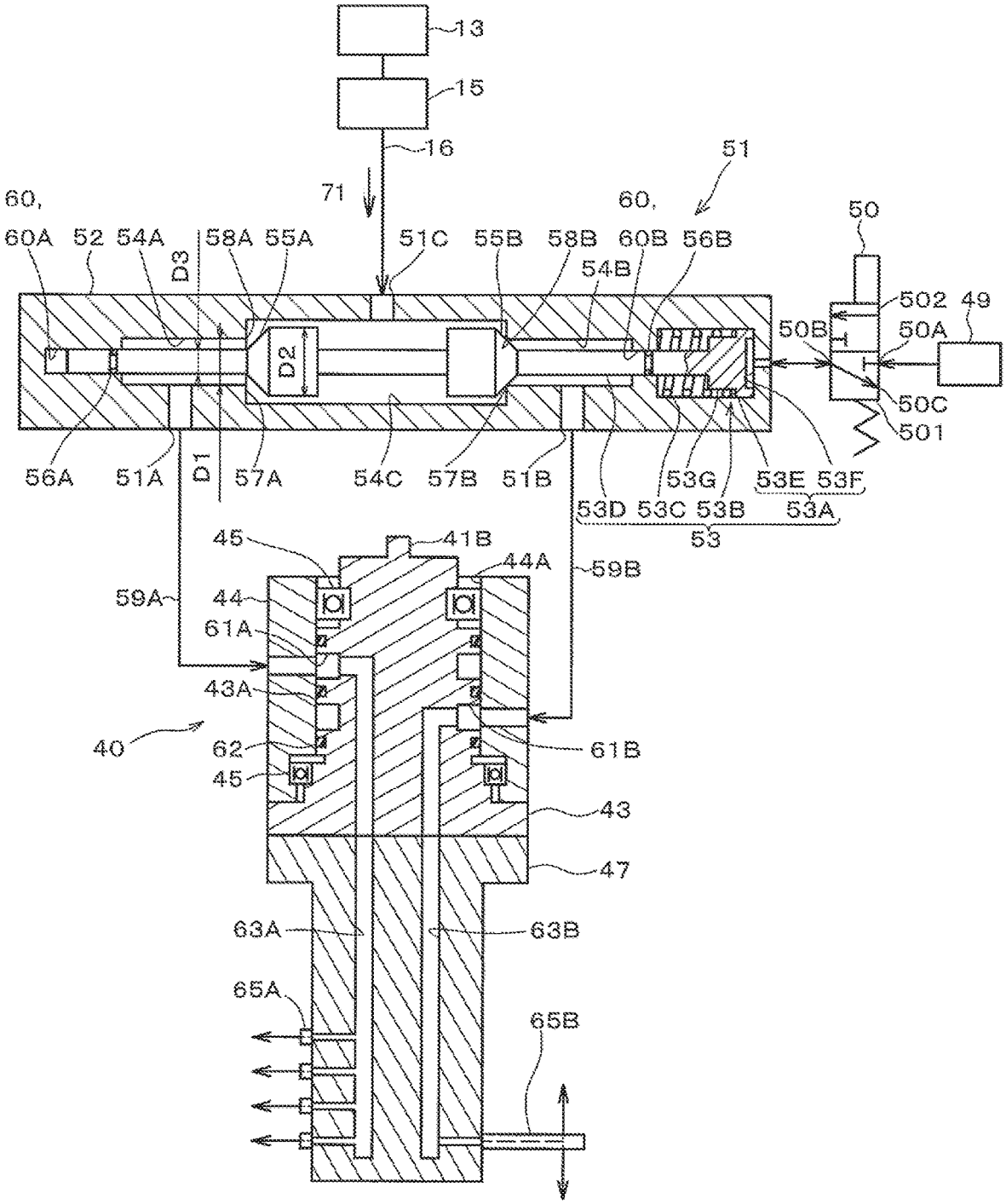
FIG. 3 is a cross-sectional view of the nozzle switching valve, spindle, and nozzle block of the embodiment.

As shown in FIG. 3, the nozzle switching valve 51 includes a valve housing 52, a first valve element 55A, a second valve element 55B, a first valve seat 57A, a second valve seat 57B, a cylinder 53, a packing 56A, and a packing 56B. The valve housing 52 has an inflow port 51C, a first nozzle port 51A, a second nozzle port 51B, an inflow chamber 54C, a first chamber 54A, a second chamber 54B, and a through hole 60. The cylinder 53 has a cylinder chamber 53A, a piston 53B, a stem 53D, and a spring 53C. The cylinder 53 may have a guide 53G.

The inflow chamber 54C, which is disposed in the center of the valve housing 52, has, for example, a cylindrical shape. The inflow chamber 54C is connected to the inflow port 51C.

The first chamber 54A, which is disposed at one end of the inflow chamber 54C (left side in FIG. 3), has, for example, a cylindrical shape. The first chamber 54A is connected to the inflow chamber 54C by a first opening 58A having a circular cross section. The first chamber 54A is connected to the first nozzle port 51A.

The second chamber 54B, which is disposed at the other end of the inflow chamber 54C (right side in FIG. 3), has, for example, a cylindrical shape. The second chamber 54B is connected to the inflow chamber 54C by a second opening 58B having a circular cross section. The second chamber 54B is connected to the second nozzle port 51B.

The through hole 60, which is a cylindrical hole, penetrates the first chamber 54A, the first opening 58A, the inflow chamber 54C, the second opening 58B, the second chamber 54B, and the cylinder chamber 53A. The through hole 60 has a first end 60A and a second end 60B. The first end 60A is disposed on the opposite side (left side in FIG. 3) of the first chamber 54A from the inflow chamber 54C. The second end 60B is disposed on the cylinder chamber 53A side (right side in FIG. 3) of the second chamber 54B. The second end 60B is connected to the cylinder chamber 53A. The through hole 60 extends coaxially with the first opening 58A, the second opening 58B, and the cylinder chamber 53A.

The spring 53C may be disposed at the end of the stem 53D on the first end 60A of the through hole 60.

The first valve element 55A has a conical shape. The first valve element 55A is made of metal such as precipitation hardening stainless steel. For example, the hardness of the first valve element 55A is lower than that of the first valve seat 57A. The first valve element 55A is in metal contact with the first valve seat 57A and seals the cleaning liquid 71. The second valve element 55B has substantially the same shape as the first valve element 55A.

Figure 4A:
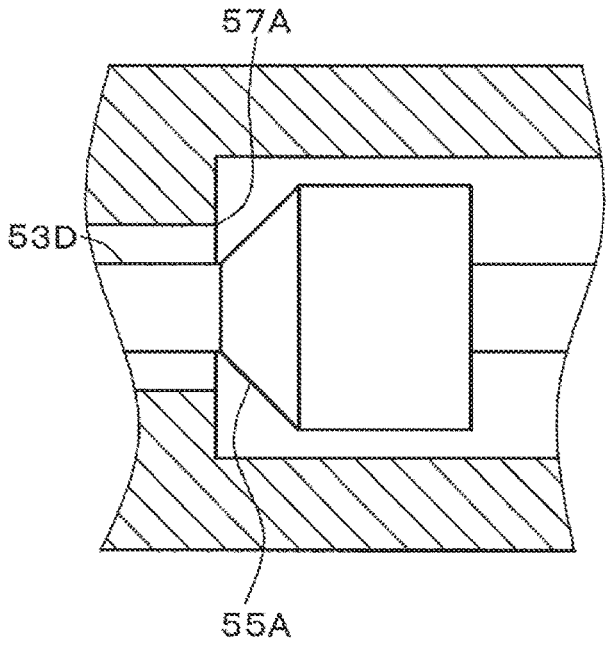
FIG. 4A is an enlarged view showing an example of a first valve seat of the embodiment.
Figure 4B:
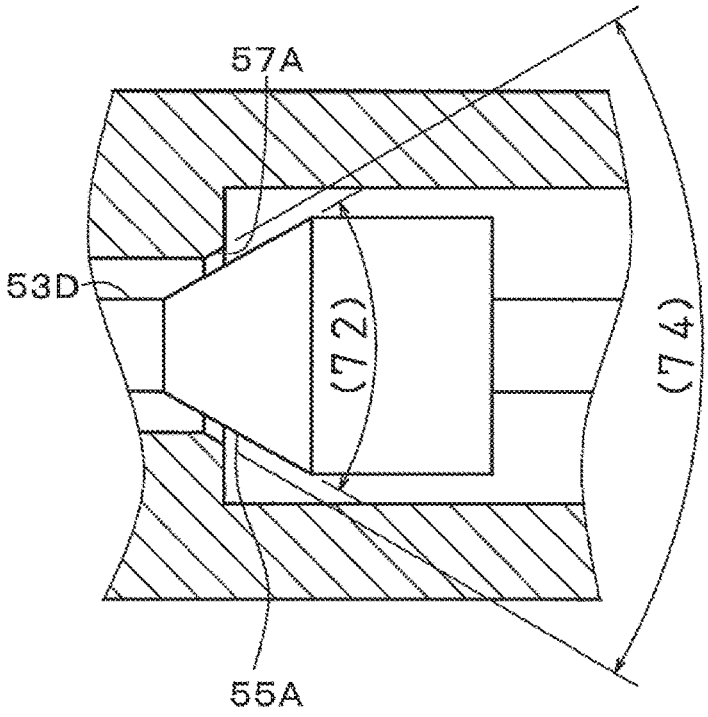
FIG. 4B is an enlarged view showing another example of the first valve seat of the embodiment.

The first valve seat 57A is disposed around the first opening 58A. The first valve seat 57A is made of metal such as precipitation hardening stainless steel. As shown in FIG. 4A, the first valve seat 57A may be an edge of the first opening 58A. As shown in FIG. 4B, the first valve seat 57A may be a tapered surface. When the first valve seat 57A is a tapered surface, the taper angle 74 of the first valve seat 57A may be the same as or slightly wider than the taper angle 72 of the first valve element 55A. For example, the taper angle 74 is 60 degrees and the taper angle 72 is 58 degrees. The second valve seat 57B has substantially the same shape as the first valve seat 57A.

The stem 53D is disposed to penetrate the through hole 60, the first chamber 54A, the first opening 58A, the inflow chamber 54C, the second opening 58B, the second chamber 54B, and the cylinder chamber 53A. The stem 53D is supported by the first end 60A and the second end 60B. The diameter of the stem 53D is smaller than the diameter of the first opening 58A. The first valve element 55A and the second valve element 55B are fixed to the stem 53D. Preferably, the stem 53D is formed integrally with the first valve element 55A and the second valve element 55B. The stem 53D slides to the ends 60A, 60B and reciprocates axially. When the stem 53D is moved to one end (left side in FIG. 3), the first valve element 55A abuts against the first valve seat 57A, and the second valve element 55B is separated from the second valve seat 57B. When the stem 53D moves to the other end (right side in FIG. 3), the second valve element 55B abuts against the second valve seat 57B, and the first valve element 55A is separated from the first valve seat 57A.

Assuming that the diameter of the first opening 58A is D1 (m), the maximum diameter of the first valve element 55A is D2 (m), and the diameter of the stem 53D inside the first chamber 54A is D3 (m), the following equation is satisfied.

$$D2>D1>D3 \quad \text{(Equation 1)}$$

The packing 56A is disposed on the stem 53D and seals between the stem 53D and the first end 60A. The packing 56B is disposed on the stem 53D and seals between the stem 53D and the second end 60B.

The cylinder chamber 53A is disposed on the opposite side (right side in FIG. 3) to the inflow chamber 54C of the second end 60B. The cylinder chamber 53A has a cylindrical shape. The piston 53B, which is disposed inside the cylinder chamber 53A, reciprocates in the cylinder chamber 53A. The piston 53B is connected to the stem 53D. Preferably, the piston 53B is integrally formed with the stem 53D. The piston 53B partitions the cylinder chamber 53A into a first cylinder chamber 53E and a second cylinder chamber 53F. A guide 53G may be disposed on the piston 53B. The spring 53C is, for example, a compression coil spring or a disc spring. The spring 53C, which is disposed in the first cylinder chamber 53E, biases the piston 53B away from the wall surface on one end side (left side in FIG. 3) of the first cylinder chamber 53E. The guide 53G has an outer diameter substantially the same as the inner diameter of the spring 53C. The guide 53G supports the spring 53C.

The solenoid valve 50 is, for example, a two-position three-port directional switching valve. The solenoid valve 50 has a port 50A connected to the compressed air source 49, a port 50B connected to the second cylinder chamber 53F, and a port 50C opened to the atmosphere. In position 501, solenoid valve 50 connects port 50B to port 50C. In position 502, solenoid valve 50 connects port 50A to port 50B. The solenoid valve 50 switches the supply of the air 75 to the second cylinder chamber 53F and the discharge of the air 75 from the second cylinder chamber 53F. The solenoid valve 50 may be a double-acting valve or a spring-back valve.

As shown in FIG. 3, the swivel joint 40 includes a swivel shaft (spindle) 43, a first annular flow path 61A, a second annular flow path 61B, a first nozzle flow path 63A, and a second nozzle flow path 63B. The swivel joint 40 may include a swivel housing 44, a bearing 45, and a plurality of packings 62. The second coupling 41B is disposed at the base end of the swivel shaft 43.

The swivel housing 44 has a hollow cylindrical shape. The swivel housing 44 has a cylindrical surface 44A on its inner surface.

The swivel shaft 43, which is cylindrical, has a cylindrical surface 43A. The swivel shaft 43 is supported inside the swivel housing 44 by a bearing 45. The cylindrical surface 43A slides on the cylindrical surface 44A. The annular flow paths 61A, 61B and the packing 62 are arranged on the cylindrical surface 43A side by side in the axial direction of the rotation axis 1. The packings 62 are disposed between the annular flow paths 61A and 61B, and outside the annular flow paths 61A, 61B. The packing 62 seals between the cylindrical surface 43A and the cylindrical surface 44A on both sides of the first annular flow path 61A and the second annular flow path 61B.

The third nozzle flow path 59A connects the first nozzle port 51A and the first annular flow path 61A. The third nozzle flow path 59A opens to the cylindrical surface 44A so as to face the first annular flow path 61A. The fourth nozzle flow path 59B connects the second nozzle port 51B and the second annular flow path 61B. The fourth nozzle flow path 59B opens to the cylindrical surface 44A so as to face the second annular flow path 61B.

As shown in FIGS. 1 and 3, the nozzle block 47 is fixed to the swivel shaft 43. The nozzle block 47, which is in a rod shape, extends along the rotation axis 1. The first nozzle 65A and the second nozzle 65B are disposed at the tip end of the nozzle block 47.

Inside the nozzle block 47 and the swivel shaft 43, a first nozzle flow path 63A and a second nozzle flow path 63B are arranged through the nozzle block 47 and the swivel shaft 43. The first nozzle flow path 63A extends along the rotation axis 1. One end of the first nozzle flow path 63A is opened to the first annular flow path 61A, and the other end of the first nozzle flow path 63A is connected to the first nozzle 65A. The second nozzle flow path 63B connects the second annular flow path 61B to the second nozzle 65B. The second nozzle flow path 63B is substantially the same as the first nozzle flow path 63A.

Figure 5:
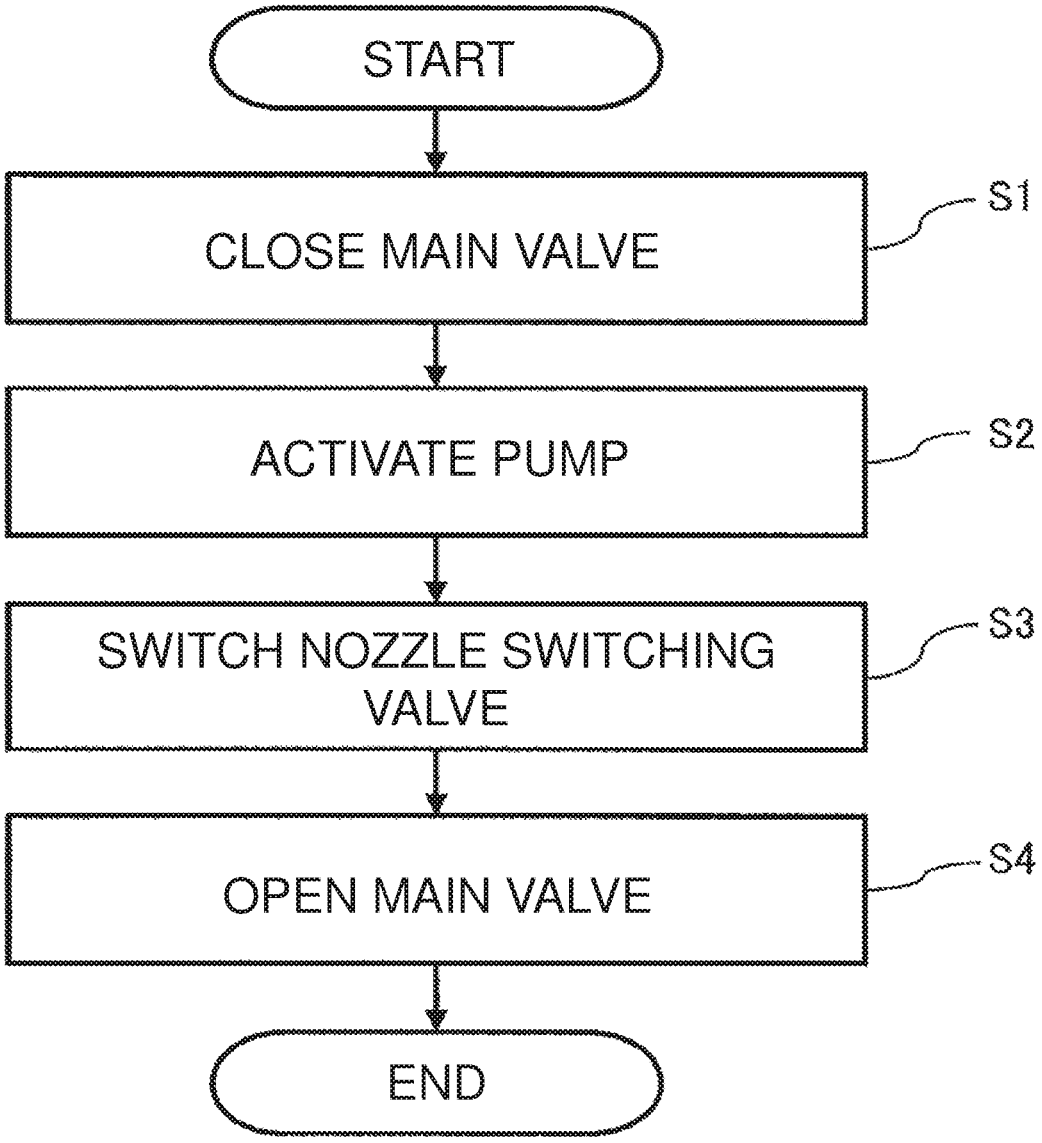
FIG. 5 is a flow chart showing a method of starting cleaning according to the embodiment.

A method of starting the injection of the cleaning liquid 71 by the cleaning machine 10 will be described with reference to FIG. 5. In step S1, the main valve 15 is closed. In step S2, the pump 13 is activated. Next, in step S3, the solenoid valve 50 is switched to switch the nozzle switching valve 51. Next, in step S4, the main valve 15 is opened. The cleaning liquid 71 is ejected from the first nozzle 65A or the second nozzle 65B through the main valve 15, the nozzle switching valve 51, the swivel joint 40, and the nozzle block 47.

Figure 6A:
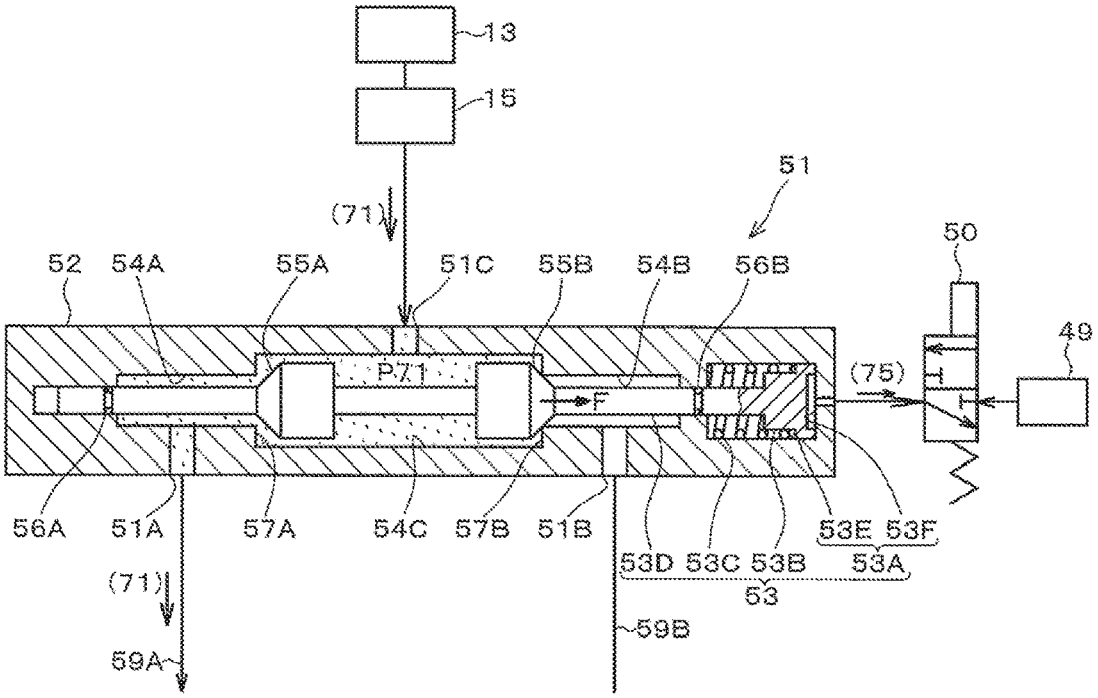
FIG. 6A is a cross-sectional view of a nozzle switching valve of the embodiment in use.

FIG. 6A shows a state in which the cleaning liquid 71 is ejected from the first nozzles 65A. Referring to FIG. 6A, the injection methods from the first nozzles 65A will be described.

In step S1, the main valve 15 is closed. Then, the cleaning liquid 71 does not flow into the inflow chamber 54C. Therefore, the pressure P71 of the cleaning liquid 71 does not act on the stem 53D.

In step S3, the solenoid valve 50 is switched to the position 501, and the air 75 is exhausted from the second cylinder chamber 53F. The piston 53B is moved to the right in FIG. 6A by the elastic force of the spring 53C. The first valve element 55A is separated from the first valve seat 57A, and the second valve element 55B is in close contact with the second valve seat 57B.

In step S4, the cleaning liquid 71 flows into the inflow chamber 54C from the inflow port 51C, passes through the gap between the first opening 58A and the stem 53D, the first chamber 54A, and flows out from the first nozzle port 51A. Since the diameter D1 is larger than the diameter D3, the pressure P71 (Pa) of the cleaning liquid 71 filled in the inflow chamber 54C pushes the stem 53D to the right side in FIG. 6A. The force F (N) exerted by the pressure P71 on the stem 53D is expressed by the following equation.

$$F = \frac{\pi}{4} P71(D1^2 - D3^2) \quad \text{(Equation 2)}$$

Figure 6B:
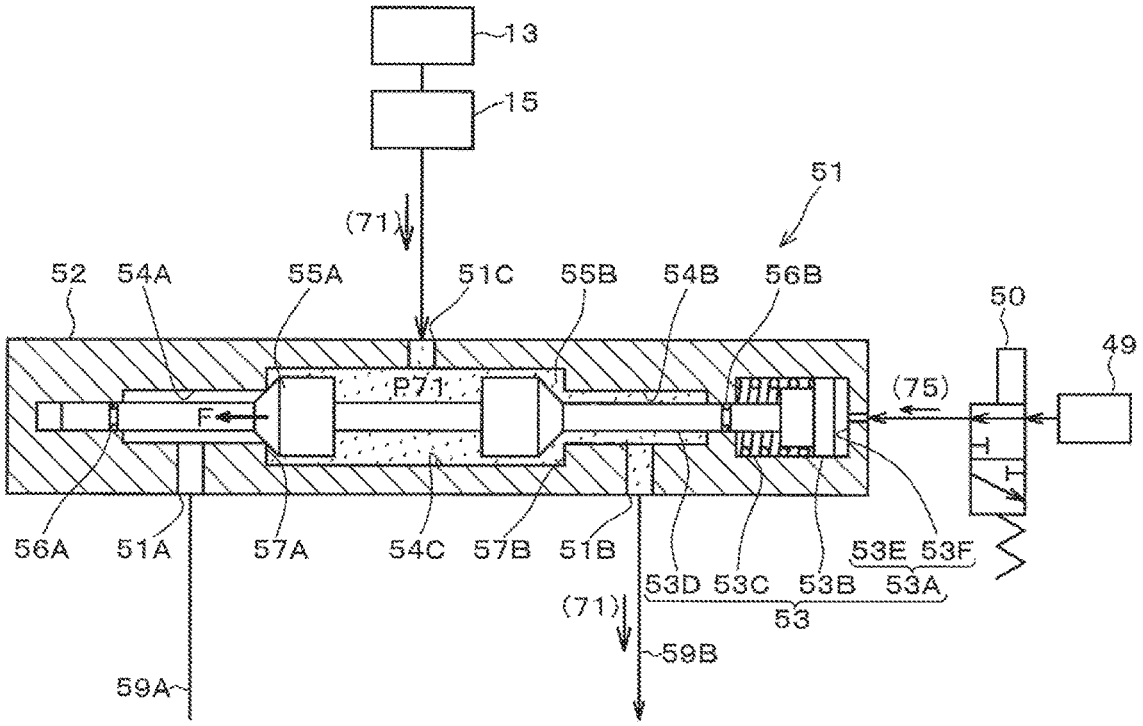
FIG. 6B is a cross-sectional view of the nozzle switching valve of the embodiment in use.

FIG. 6B shows a state in which the cleaning liquid 71 is ejected from the second nozzle 65B. Referring to FIG. 6B, the injection methods from the second nozzle 65B will be described.

In step S3, the solenoid valve 50 is switched to the position 502, and air 75 is supplied to the second cylinder chamber 53F. At this time, the pressure P71 does not act on the stem 53D. The piston 53B moves to the left in FIG. 6B against the elastic force of the spring 53C.

In step S4, the cleaning liquid 71 flows into the inflow chamber 54C from the inflow port 51C, and flows out from the second nozzle port 51B through the gap between the second opening 58B and the stem 53D, and the second chamber 54B. The pressure P71 of the cleaning liquid 71 filled in the inflow chamber 54C pushes the stem 53D to the left side in FIG. 6B. The force F exerted by the cleaning liquid 71 is expressed by Equation 2.

During injection, even when either the first nozzle 65A or the second nozzle 65B is selected, the stem 53D is pressed by the force F to the valve closing side by the pressure P71. As the pressure P71 increases, the force F increases.

On the other hand, when the nozzle switching valve 51 is driven in step S3, the pressure P71 does not act on the stem 53D because the main valve 15 is closed. Therefore, the pressure P75 of the air 75 may have a level at which the piston 53B can move to one end (left side in FIG. 6B) against the compressive force of the spring 53C. The pressure P75 and the diameter of the piston 53B are determined only by the compression force of the spring 53C. The diameter of the piston 53B is independent of the pressure P71. Therefore, the piston 53B can be miniaturized.

Figure 7:
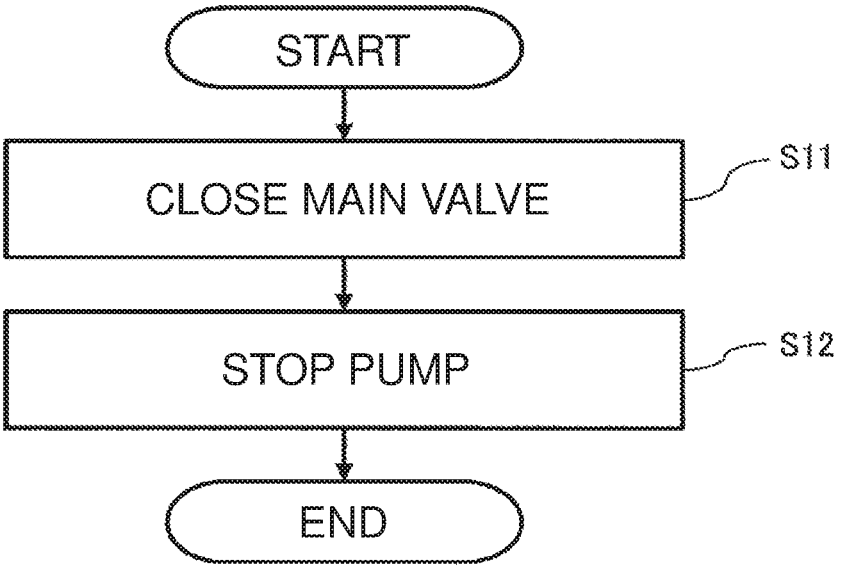
FIG. 7 is a flow chart showing the method of stopping cleaning according to the embodiment.

A method of stopping the injection of the first nozzle 65A or the second nozzle 65B will be described with reference to FIG. 7. In step S11, the main valve 15 is stopped. In step S12, the pump 13 is stopped. Step S12 may be omitted.

Since the pressure P71 presses the stem 53D to the valve dosing side and the pressure P75 of the air 75 is independent of the pressure P71, the cleaning machine 10 is suitable for use of the high-pressure cleaning liquid 71. Since the switching of the nozzles 65A and 65B is performed by the solenoid valve 50 disposed outside the cleaning chamber 17, the cleaning machine 10 is hardly damaged by the jetted cleaning liquid 71 or its spray.

The nozzle switching valve 51 and the manifold 69 are arranged in the head portion 21A apart from the nozzles 65A or 65B. Therefore, the nozzle switching valve 51 and the manifold 69 hardly hinder the movement of the first nozzle 65A or the second nozzle 65B, and the first nozzle 65A or the second nozzle 65B can approach the object 67.

It should be noted that the present invention is not limited to the embodiments described above, and various modifications can be made without departing from the gist of the present invention, and all technical matters included in the technical idea described in the claims are the subject matter of the present invention. While the foregoing embodiments illustrate preferred examples, those skilled in the art will appreciate that various alternatives, modifications, variations, or improvements may be made in light of the teachings disclosed herein and are within the scope of the appended claims.

REFERENCE SIGNS LIST

10 Cleaning machine
13 Pump
15 Main valve
21 Slide
23 Motor
40 Swivel joint
49 Compressed air source
51 Nozzle switching valve
53A Cylinder chamber
53B Piston
53C Spring
53D Stem
54A First chamber

54B Second chamber
54C Inflow chamber
55A, 55B Valve element
57A, 57B Valve seat
58A, 58B Opening
59A Third nozzle flow path
59B Fourth nozzle flow path
63A First nozzle flow path
63B Second nozzle flow path
61A, 61B Annular flow path

What is claimed is:

1. A cleaning machine, comprising:
a slide having a head portion;
a pump configured to discharge cleaning liquid;
a main valve connected to the pump;
a nozzle switching valve arranged to the head portion, the nozzle switching valve including:
a valve housing,
an inflow chamber having an inflow port connected to the main valve,
a first chamber having a first nozzle port, a first opening, and a first valve seat arranged around the first opening, the first chamber connected to the inflow chamber via the first opening,
a second chamber having a second nozzle port, a second opening, and a second valve seat arranged around the second opening, the second chamber connected to the inflow chamber via the second opening,
a stem slidably supported by the valve housing, the stem penetrating the inflow chamber, the first opening, and the second opening,
a first valve element having a conical shape, the first valve element arranged on the stem inside the inflow chamber, the first valve element configured to abut against the first valve seat,
a second valve element having a conical shape, the second valve element arranged on the stem inside the inflow chamber, the second valve element configured to abut against the second valve seat,
a cylinder chamber arranged along the stem,
a piston partitioning the cylinder chamber into a first cylinder chamber and a second cylinder chamber, the piston configured to slide inside the cylinder chamber, the piston connected to the stem, and
a spring configured to urge the piston from the first cylinder chamber toward the second cylinder chamber;
a compressed air source connected to the second cylinder chamber;
a swivel joint arranged to the head portion, the swivel joint including:
a swivel housing,
a swivel shaft rotatably supported inside the swivel housing,
a first annular flow path and a second annular flow path arranged in the swivel shaft,
a first nozzle flow path, and
a second nozzle flow path;
a third nozzle flow path directly connecting the first nozzle port and the first annular flow path;
a fourth nozzle flow path directly connecting the second nozzle port and the second annular flow path;
a motor configured to rotate the swivel shaft; and
a nozzle block arranged to the swivel shaft, the nozzle block including:
a first nozzle connected to the first nozzle flow path, and
a second nozzle connected to the second nozzle flow path, wherein
the first nozzle flow path connects the first annular flow path and the first nozzle, and
the second nozzle flow path connects the second annular flow path and the second nozzle.

2. The cleaning machine according to claim 1, wherein the spring is arranged in the first cylinder chamber.

3. The cleaning machine according to claim 1, wherein the swivel shaft extends perpendicular to the slide.

4. The cleaning machine according to claim 1, wherein the nozzle switching valve has a through hole extending along the first chamber, the inflow chamber, the second chamber, and the cylinder chamber, and
the stem slides inside the through hole.

5. The cleaning machine according to claim 1, wherein the first valve seat, the second valve seat, the first valve element, and the second valve element are made of metal.

6. The cleaning machine according to claim 1, wherein the first valve element and the second valve element each has a tapered surface having a first taper angle.

7. The cleaning machine according to claim 6, wherein the first valve seat and the second valve seat each has a tapered surface having a second taper angle that is larger than the first taper angle.

8. The cleaning machine according to claim 1, further comprising:
a solenoid valve configured to switch supplying compressed air from the compressed air source to the second cylinder chamber, and discharging the compressed air from the second cylinder chamber to outside.

9. The cleaning machine according to claim 1, further comprising:
a cleaning flow path having a first inlet located at a base end of the slide, the first inlet connected to the main valve, the cleaning flow path connecting the first inlet and the nozzle switching valve, the cleaning flow path arranged inside the slide;
an air flow path having an air inlet located at the base end of the slide, the air inlet connected to the compressed air source, the air flow path connecting the air inlet and the second cylinder chamber, the air flow path arranged inside the slide; and
a manifold having the cleaning flow path and the air flow path inside.

10. The cleaning machine according to claim 2, wherein the swivel shaft extends perpendicular to the slide.

11. The cleaning machine according to claim 2, wherein the nozzle switching valve has a through hole extending along the first chamber, the inflow chamber, the second chamber, and the cylinder chamber, and
the stem slides inside the through hole.

12. The cleaning machine according to claim 3, wherein the nozzle switching valve has a through hole extending along the first chamber, the inflow chamber, the second chamber, and the cylinder chamber, and
the stem slides inside the through hole.

13. The cleaning machine according to claim 2, wherein the first valve seat, the second valve seat, the first valve element, and the second valve element are made of metal.

14. The cleaning machine according to claim 3, wherein the first valve seat, the second valve seat, the first valve element, and the second valve element are made of metal.

15. The cleaning machine according to claim 1, wherein the inflow chamber is located at a center of the valve housing.

* * * * *